US010337756B2

(12) United States Patent
Han et al.

(10) Patent No.: US 10,337,756 B2
(45) Date of Patent: Jul. 2, 2019

(54) AIR CONDITIONER AND METHOD FOR CONTROLLING THE SAME

(71) Applicant: Samsung Electronics Co., Ltd., Suwon-si (KR)

(72) Inventors: Chang Hee Han, Osan-si (KR); Tae Il Kim, Hwaseong-si (KR); Jae-Sung Yoo, Yongin-si (KR); Hyeong Seok Lim, Suwon-si (KR); Yong Hee Jang, Yongin-si (KR); Hyeong Joon Seo, Suwon-si (KR); Hong Seok Jun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/691,152

(22) Filed: Aug. 30, 2017

(65) Prior Publication Data

US 2018/0087797 A1 Mar. 29, 2018

(30) Foreign Application Priority Data

Sep. 26, 2016 (KR) ..... 10-2016-0122812

(51) Int. Cl.
*F24F 11/81* (2018.01)
*F24F 11/30* (2018.01)
(Continued)

(52) U.S. Cl.
CPC ..... *F24F 11/81* (2018.01); *F24F 1/38* (2013.01); *F24F 1/48* (2013.01); *F24F 1/50* (2013.01);
(Continued)

(58) Field of Classification Search
CPC ..... F24F 1/38; F24F 1/48; F24F 1/50; F24F 11/30; F24F 11/70; F24F 11/81;
(Continued)

(56) References Cited

U.S. PATENT DOCUMENTS

2012/0036873 A1 2/2012 Bush
2017/0089628 A1* 3/2017 Jang ..... F24F 1/0011

FOREIGN PATENT DOCUMENTS

EP 2 725 306 A2 4/2014
EP 2 977 688 A1 1/2016
WO WO 2006/129891 A2 12/2006

OTHER PUBLICATIONS

Extended European Search Report dated Mar. 7, 2018, in corresponding European Patent Application No. 17190235.6.

* cited by examiner

*Primary Examiner* — Marc E Norman
(74) *Attorney, Agent, or Firm* — Staas & Halsey LLP

(57) ABSTRACT

An air conditioner and a method for controlling the same are disclosed. The air conditioner is able to operate in an efficient cooling cycle while simultaneously guaranteeing superior cooling performance in a low-temperature operation region. In the air conditioner, an airflow directing apparatus, which is installed in an outdoor unit, suppresses not only natural convection of the air, but also heat exchange between the condenser and outdoor air by the blowing fan, such that the air conditioner forms a normal cooling cycle by guaranteeing condenser pressure. The air conditioner guarantees cooling performance of a low-temperature operation region by adjusting the amount of outdoor air flowing through blade control of the airflow directing apparatus, and operates in an efficient cooling cycle, resulting in acquisition of compressor reliability.

18 Claims, 11 Drawing Sheets

(51) Int. Cl.

| | |
|---|---|
| ***F24F 11/70*** | (2018.01) |
| ***F24F 1/38*** | (2011.01) |
| ***F24F 1/48*** | (2011.01) |
| ***F24F 13/14*** | (2006.01) |
| ***F24F 13/15*** | (2006.01) |
| ***F24F 1/50*** | (2011.01) |
| *F24F 110/00* | (2018.01) |
| *F24F 1/0003* | (2019.01) |
| *F24F 110/12* | (2018.01) |
| *F24F 140/12* | (2018.01) |

(52) U.S. Cl.
CPC ..... *F24F 11/30* (2018.01); *F24F 11/70* (2018.01); *F24F 13/1413* (2013.01); *F24F 13/15* (2013.01); *F24F 1/0003* (2013.01); *F24F 2110/00* (2018.01); *F24F 2110/12* (2018.01); *F24F 2140/12* (2018.01)

(58) Field of Classification Search
CPC ..... F24F 13/14; F24F 13/1413; F24F 13/15; F24F 2110/00; F24F 2110/12; F25B 2700/1931; F25B 2700/1933
See application file for complete search history.

FIG. 9

| COMPRESSION RATIO | LOW PRESSURE | THE AMOUNT OF CHANGE FOR EACH STEP OF BLADE | | |
|---|---|---|---|---|
| | | 0 step | 1 step/2 step | 3 step |
| ≥ 2.8 | ≥ 6 | 60 | 40 | 0 |
| | < 6 | 0 | -40 | -50 |
| ≥ 2.4 ~ < 2.8 | ≥ 6 | 50 | 30 | 0 |
| | < 6 | 0 | -50 | -50 |
| < 2.4 | ≥ 8 | 0 | -30 | -40 |
| | ≥ 6 ~ < 8 | 0 | -40 | -50 |
| | < 6 | 0 | -50 | -60 |

AIR CONDITIONER AND METHOD FOR CONTROLLING THE SAME

CROSS-REFERENCE TO RELATED APPLICATION

This application claims the benefit of Korean Patent Application No. 10-2016-0122812, filed on Sep. 26, 2016 in the Korean Intellectual Property Office, the disclosure of which is incorporated herein by reference.

BACKGROUND

1. Field

Embodiments of the present disclosure relate to an air conditioner capable of operating in an efficient cooling cycle while simultaneously guaranteeing superior cooling performance in a low-temperature operation region, and a method for controlling the same.

2. Description of the Related Art

An air conditioner is an apparatus that adjusts temperature, humidity, airflow, etc. of indoor air using movement of heat generated during evaporation and condensation of refrigerant that circulates in a cooling cycle including a compressor, a condenser, an expansion valve, and an evaporator.

Air conditioners may be classified into a split type air conditioner having an indoor unit and an outdoor unit separately installed, and an integrated type air conditioner having an indoor unit and an outdoor unit installed together in one cabinet. The split type air conditioner includes an indoor unit installed indoors and an outdoor unit connected to the indoor unit through a refrigerant pipe and installed outdoors.

The indoor unit of the air conditioner may include an indoor heat-exchanger (hereinafter referred to as an evaporator) configured to heat exchange between refrigerant and indoor air, and an indoor fan configured to flow and circulate indoor air. The outdoor unit of the air conditioner may include an outdoor heat-exchanger (hereinafter referred to as a condenser) configured to exchange refrigerant with outdoor air, a compressor configured to compress refrigerant and provide the compressed refrigerant to the condenser, and an outdoor fan (hereinafter referred to as a blowing fan) configured to flow and circulate outdoor air.

A typical air conditioner generally connects a single indoor unit to a single outdoor unit. However, in recent times, demand for a multi-system air conditioner which connects a plurality of indoor units to at least one outdoor unit to cool or warm indoor air of each space of a building (e.g., a school, a company, a hospital, etc.) having a plurality of independent spaces, is rapidly increasing.

Operation capacity of the outdoor unit of the multi-system air conditioner is changed according to change in capacity of the indoor unit, such that pressure of the condenser of the cooling cycle may excessively increase or decrease. The condenser pressure of the cooling cycle may be formed by heat-exchange between the condenser and outdoor air according to driving of the blowing fan. Generally, the higher the amount of heat exchange, the lower the condenser pressure. Since condenser pressure and evaporator pressure are directly associated with capacity and efficiency of the cooling cycle, the condenser pressure and the evaporator pressure should be formed in a compressor guarantee operation region.

The outdoor unit of the multi-system air conditioner may include an upper discharge-type outdoor unit through which heat-exchanged air is discharged upward, such that the air exchanges heat by natural convection of the air without driving the blowing fan at an outdoor low-temperature condition. Therefore, when the cooling operation is performed in an outdoor low-temperature condition, the multi-system air conditioner may have difficulty in guaranteeing the condenser pressure due to natural convection of the air and heat exchange between the condenser and the outdoor air by the blowing fan. If the condenser pressure is high, power consumption increases, resulting in reduction in efficiency of the cooling cycle. If the condenser pressure is low, the multi-system air conditioner deviates from the compressor operation region, resulting in reduction in compressor reliability.

SUMMARY

Therefore, it is an aspect of the present disclosure to provide an air conditioner for installing an airflow directing apparatus into an outdoor unit, such that the air conditioner may guarantee condenser pressure at an outdoor low-temperature condition and form a normal cooling cycle during a cooling operation.

It is an aspect of the present disclosure to provide an air conditioner for guaranteeing cooling performance in a low-temperature operation region by adjusting the amount of flowing outdoor air through blade control of the airflow directing apparatus, and capable of operating in an efficient cooling cycle, and a method for controlling the same.

Additional aspects of the invention will be set forth in part in the description which follows and, in part, will be obvious from the description, or may be learned by practice of the invention.

In accordance with one aspect of the present disclosure, an air conditioner includes: a cabinet configured to form an external appearance of an outdoor unit, and have an air inlet and an air outlet; a heat-exchanger accommodated in the cabinet; a blowing fan configured to suction air through the air inlet, perform heat exchange of the suctioned air in the heat-exchanger, and discharge the heat-exchanged air through the air outlet; an airflow directing apparatus provided at an upper part of the air outlet, and configured to direct flow of the air heat-exchanged in the heat-exchanger; and at least one blade provided at an outlet of the airflow directing apparatus, and configured to adjust the amount of the air heat-exchanged in the heat-exchanger.

The air conditioner may further include: a compressor disposed in the cabinet, and configured to compress a refrigerant, wherein the heat-exchanger is configured to condense the refrigerant discharged from the compressor through heat exchange between the refrigerant and the air.

The condenser may be configured to surround a back surface and both side surfaces of the cabinet, resulting in heat exchange between the condenser and the air suctioned toward the back surface and both side surfaces of the cabinet through the air inlet.

The air conditioner may further include: at least one pressure sensor mounted to a discharge part and a suction part of the compressor, and configured to detect pressure of a high pressure part of the refrigerant passing through the compressor and pressure of a low pressure part of the refrigerant passing through the compressor; a controller configured to control the amount of heat exchange by controlling an angle (or step) of the blade, wherein the controller controls the angle (or step) of the blade according to low pressure detected by the pressure sensor, a compression ratio, and a current angle (or step) of the blade.

The compression ratio may be a value that is acquired by dividing the high pressure detected by the pressure sensor by the low pressure.

If the high pressure detected by the pressure sensor is equal to or less than a minimum high pressure, the controller may control the angle (or step) of the blade in a fully closed step output, thereby closing the outlet of the airflow directing apparatus.

If the high pressure detected by the pressure sensor is higher than a minimum high pressure, the controller may control the angle (or step) of the blade in an open step output, thereby adjusting the amount of flow of the air heat-exchanged in the heat-exchanger.

If the high pressure detected by the pressure sensor is higher than a minimum high pressure, the controller may control the angle (or step) of the blade in an open step output or a close step output according to low pressure detected by the pressure sensor, a compression ratio, and a current angle (or step) of the blade, thereby adjusting the amount of flow of the air heat-exchanged in the heat-exchanger.

The air conditioner may further include an outdoor temperature sensor configured to detect a temperature of an outdoor space including the outdoor unit, wherein the controller may compare the outdoor temperature detected by the outdoor temperature sensor with a reference temperature, may determine an outdoor low-temperature condition when the outdoor temperature is less than the reference temperature, and may control the angle (or step) of the blade in a low-temperature operation region.

The airflow directing apparatus may be provided at an upper part of the cabinet to direct the air discharged to a top surface of the cabinet through the air outlet, and is formed to cover the air outlet.

The airflow directing apparatus may include a suction directing cover provided at a back surface and both side surfaces of the cabinet so as to direct the air suctioned toward the back surface and both side surfaces of the cabinet through the air inlet, and configured to surround the back surface and both side surfaces of the cabinet.

In accordance with another aspect of the present disclosure, a method for controlling an air conditioner which includes a cabinet having an air inlet and an air outlet; a heat-exchanger accommodated in the cabinet; a compressor provided in the cabinet to compress a refrigerant; an airflow directing apparatus configured to direct flow of the air heat-exchanged in the heat-exchanger; and at least one blade provided at an outlet of the airflow directing apparatus includes: detecting an outdoor temperature; comparing the detected outdoor temperature with a reference temperature, and determining whether the outdoor temperature is less than the reference temperature; if the outdoor temperature is less than the reference temperature, detecting a pressure (P1) of a high-pressure part and a pressure (P2) of a low-pressure part of the refrigerant passing through the compressor; and controlling an angle (or step) of the blade according to the detected low pressure, a compression ratio, and a current angle (or step) of the blade.

The controlling the blade may include: suctioning the air through the air inlet, adjusting the amount of flow of the air discharged from the air outlet through heat exchange of the suctioned air in the heat-exchanger, and thus controlling the amount of heat exchange of the heat-exchanger.

The method may further include: if the detected high pressure is equal to or less than a minimum high pressure, controlling the angle (or step) of the blade in a fully closed step output, and thus closing an outlet of the airflow directing apparatus.

The method may further include: if the detected high pressure is higher than a minimum high pressure, controlling the angle (or step) of the blade in an open step output, and thus adjusting the amount of flow of the air.

The method may further include: if the detected high pressure is higher than a minimum high pressure, controlling the angle (or step) of the blade in an open step output or a close step output according to the detected low pressure, a compression ratio, and a current angle (or step) of the blade, thereby adjusting the amount of flow of the air heat-exchanged in the heat-exchanger.

BRIEF DESCRIPTION OF THE DRAWINGS

These and/or other aspects of the invention will become apparent and more readily appreciated from the following description of the embodiments, taken in conjunction with the accompanying drawings of which:

FIG. 9 is a table illustrating the amount of change for each step of blades in a low-temperature operation region of the outdoor unit of the air conditioner according to an embodiment of the present disclosure.

DETAILED DESCRIPTION

Figure 1:
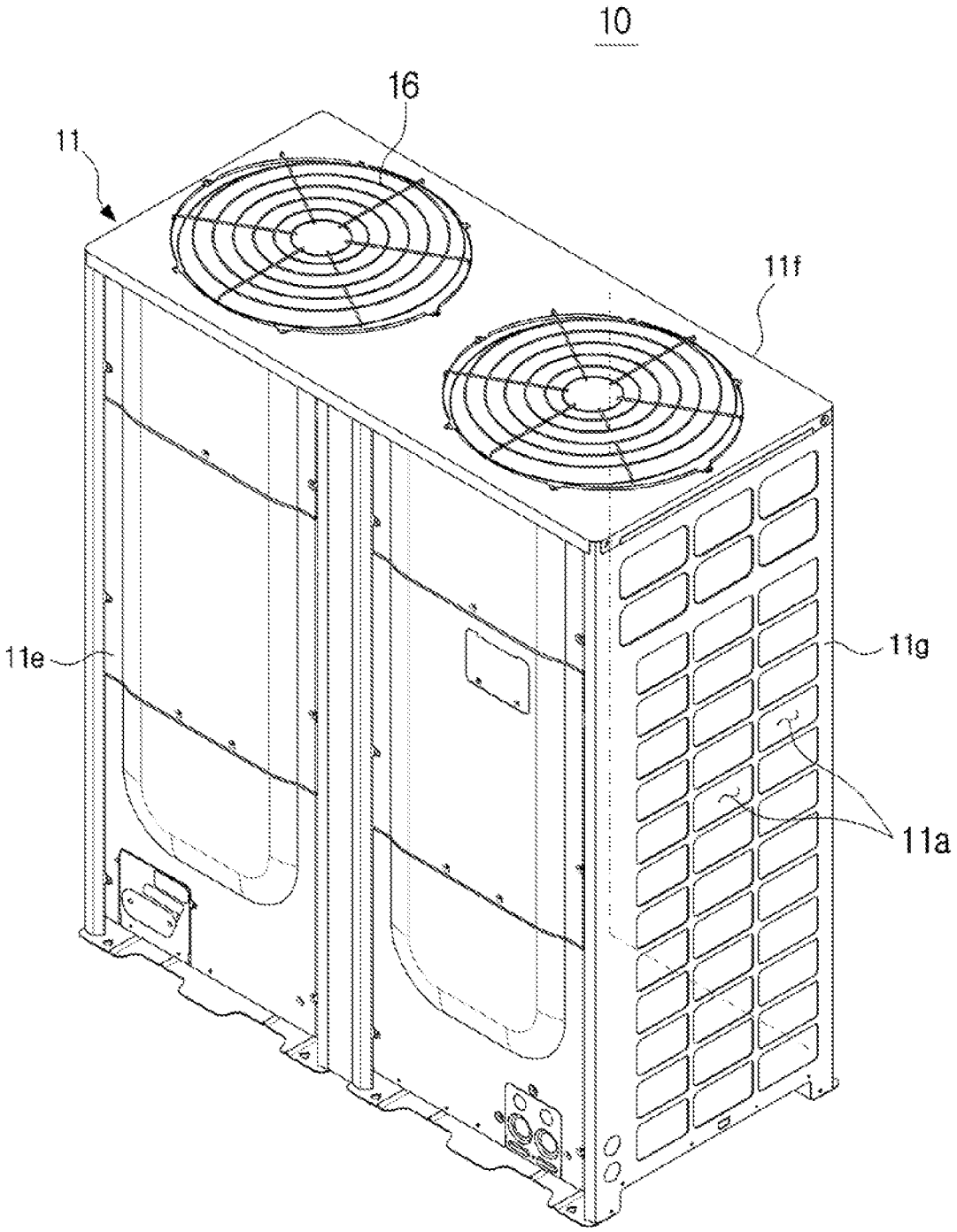
FIG. 1 is a perspective view illustrating an outdoor unit of an air conditioner according to an embodiment of the present disclosure.

Reference will now be made in detail to the embodiments of the present disclosure, examples of which are illustrated in the accompanying drawings, wherein like reference numerals refer to like elements throughout.

The terms used in the present application are merely used to describe specific embodiments and are not intended to limit the present disclosure. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component. For example, a first component may be called a second component and a second component may be called a first component without departing from the scope of the present disclosure. The term "and/or" may include a combination of a plurality of items or any one of a plurality of items.

In description of the present disclosure, the terms "upper side", "upward direction", "lower side", and "downward direction" will hereinafter be referred to as upward and downward directions of the outdoor unit of the air conditioner according to one embodiment. That is, a side located above the outdoor unit of the air conditioner of FIG. 1 will hereinafter be referred to as an upper side, and the other side located below a lower part of the outdoor unit of the air conditioner of FIG. 1 will hereinafter be referred to as a lower side.

In association with the terms "front side", "front part", "rear side" and "rear part" used in the present disclosure, a direction of a front cabinet of the outdoor unit of the air conditioner shown in FIG. 1 will hereinafter be referred to as a forward direction, and a direction of a rear cabinet not shown in FIG. 1 will hereinafter be referred to as a backward direction.

Although the outdoor unit of the air conditioner according to the embodiment has been disclosed using blades configured to vertically adjust flow of discharged air as an example, the scope or spirit of the present disclosure is not limited thereto, and it should be noted that the present disclosure may also be applied to an outdoor unit of another air conditioner having blades configured to horizontally adjust flow of discharged air.

In addition, although the outdoor unit of the air conditioner according to one embodiment of the present disclosure has been disclosed using the outdoor unit of the air conditioner having a rectangular condenser (i.e., a heat-exchanger) as an example, the scope or spirit of the present disclosure is not limited thereto, and it should be noted that the present disclosure may also be applied to other air conditioners having annular condensers or various shapes of condensers.

The embodiments of the present disclosure will hereinafter be described with reference to the attached drawings.

Figure 2:
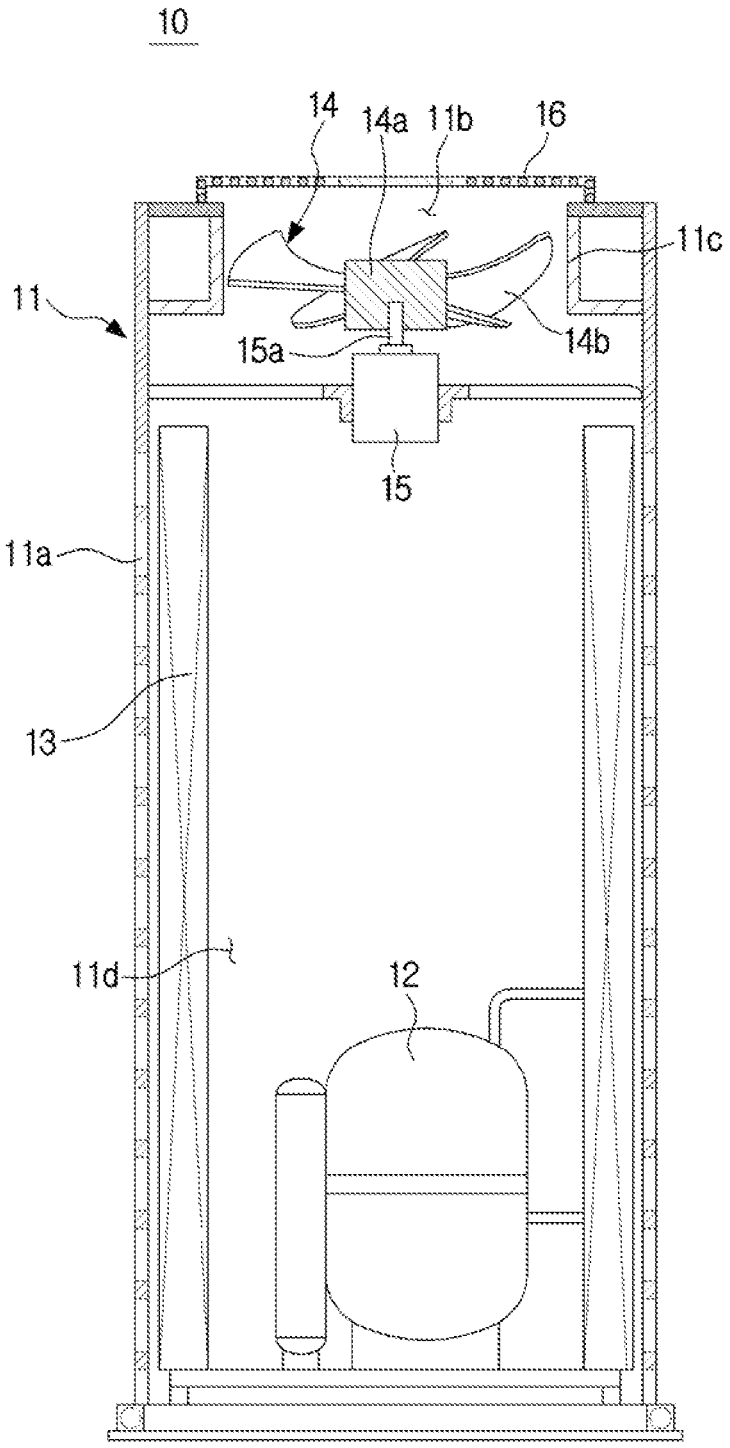
FIG. 2 is a cross-sectional view illustrating the outdoor unit of the air conditioner shown in FIG. 1.

FIG. 1 is a perspective view illustrating an outdoor unit of an air conditioner according to an embodiment of the present disclosure. FIG. 2 is a cross-sectional view illustrating the outdoor unit of the air conditioner shown in FIG. 1.

Referring to FIGS. 1 and 2, the outdoor unit 10 of the air conditioner may include a cabinet 11 forming the external appearance thereof; a compressor 12 installed in the cabinet 11 to compress refrigerant; a condenser 13 to exchange heat with outdoor air; a blowing fan 14 to flow and circulate air such that outdoor air passes through the cabinet 11 and exchanges heat with the condenser 13; and a blowing motor 15 to generate driving force needed to rotate the blowing fan 14.

The cabinet 11 may include an air inlet 11*a* to allow outdoor air to be suctioned into the cabinet 11, and an air outlet 11*b* to allow air having exchanged heat with the condenser 13 to be re-discharged to outdoor space.

The cabinet 11 may include four orthogonal sides, i.e., a front surface 11*e* disposed at a front surface of the outdoor unit 10 of the air conditioner; a back surface 11*f* disposed at a back surface of the outdoor unit 10; and one pair of side cabinets 11*g* disposed at both sides of the outdoor unit 10.

The air inlet 11*a* may be provided at a back surface and both sides of the cabinet 11, and the air outlet 11*b* may be provided at a top surface of the cabinet 11. The blowing fan 14 may be installed in an upper part of the cabinet 11, and the air outlet 11*b* may be provided at an upper end of the cabinet 11, such that a bell mouth 11*c* may direct air discharged from the cabinet 11.

Figure 6:
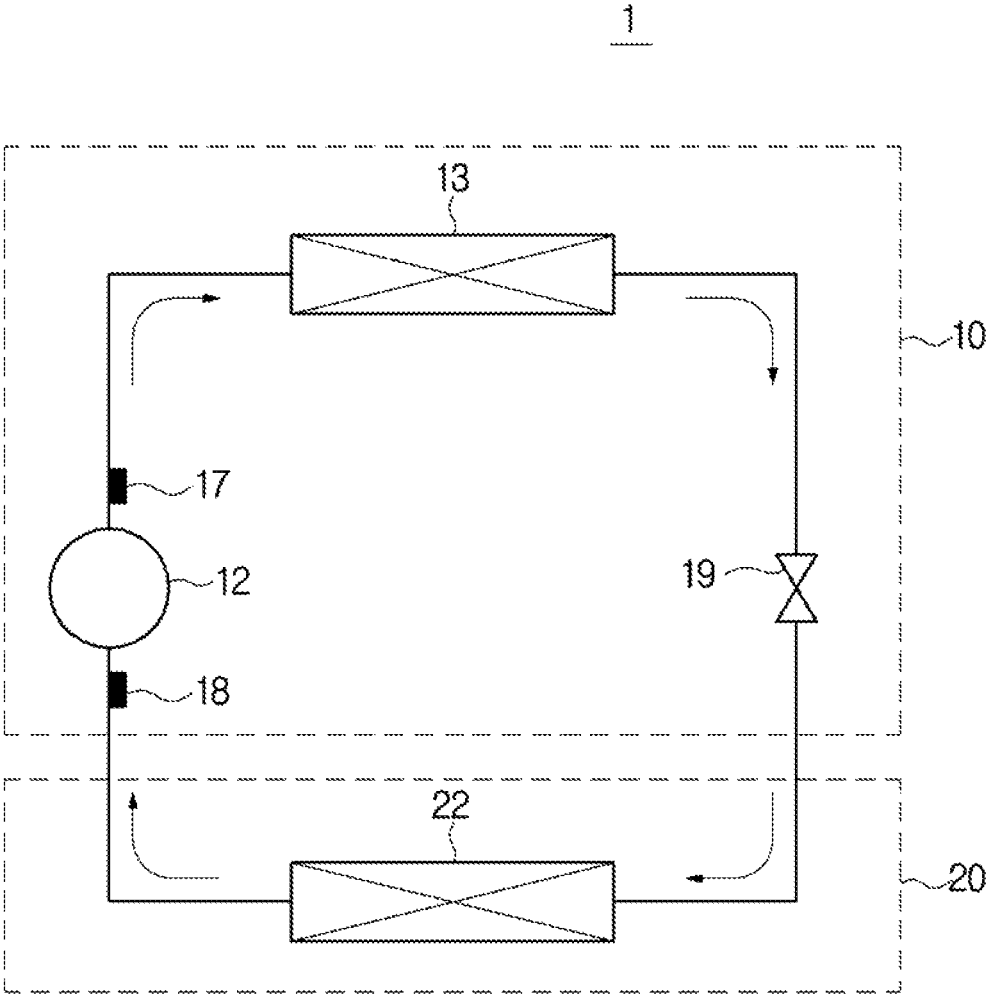
FIG. 6 is a conceptual diagram illustrating a cooling cycle of the air conditioner according to an embodiment of the present disclosure.

The compressor 12 may be installed in an electric equipment chamber 11*d* partitioned at a lower part of the cabinet 11, and may compress refrigerant received from the condenser 13 or the evaporator (see 22 of FIG. 6).

The condenser 13 may surround the back cabinet 11*f* and one pair of side cabinets 11*g*, such that the condenser 13 may exchange heat with outdoor air suctioned into the cabinet 11 through the air inlet 11*a*.

An axis of the blowing fan 14 may be arranged to face a vertical direction in the bell mouth 11*c*, such that air may be discharged to the air outlet 11*b* provided at an upper part of the cabinet 11.

Referring to FIG. 2, the blowing fan 14 may include a hub portion 14*a* in which an axis 15*a* of a blowing motor 15 is installed at the center thereof such that the hub portion 14*a* receives rotational force from the blowing motor 15; and a plurality of blades 14*b* formed to extend outward from the hub portion in a radial direction and spaced apart from one another in a circumferential direction.

A fan guard 16 facing the air outlet 11*b* may be provided at an upper part of the air outlet 11*b* so as to protect the blowing fan 14. In more detail, the fan guard 16 may be formed in a circular grille shape covering the air outlet 11*b* and the bell mouth 11*c*.

The outdoor unit 10 of the air conditioner may suction outdoor air, may heat-exchange the outdoor air with the condenser 13, and may discharge the heat-exchanged air to the outdoor space. Likewise, the outdoor unit 10 may be formed in an upper discharge-type outdoor unit having the air outlet 11*b* through which heat-exchanged air from the condenser 13 is discharged upward.

The outdoor unit 10 of the air conditioner may further include the airflow directing apparatus 40 for directing the flow of air such that the suctioned outdoor air exchanges heat with the condenser 13 and is discharged to the outdoor space through the air outlet 11*b*. A detailed description thereof will hereinafter be given with reference to FIG. 3.

Figure 3:
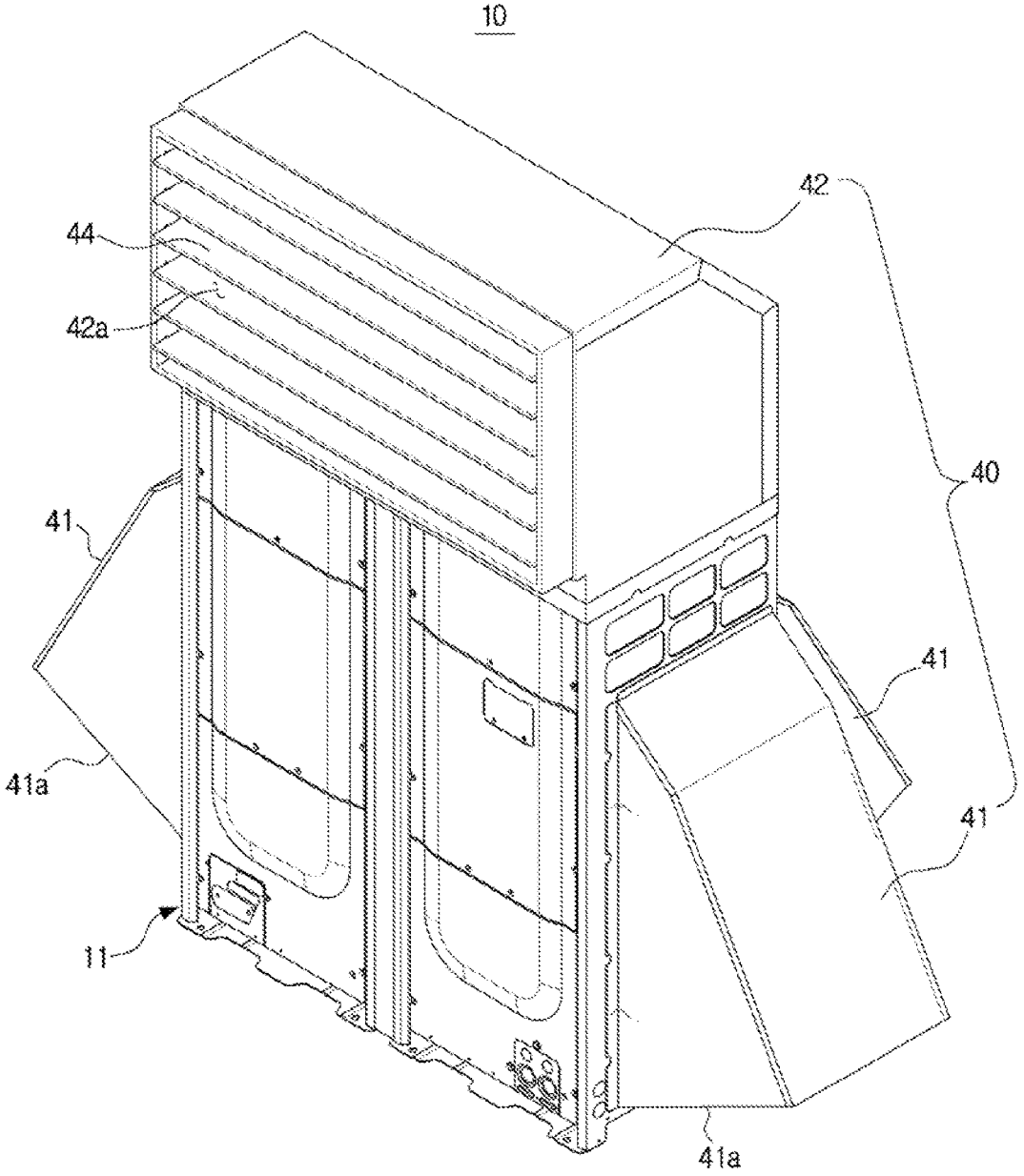
FIG. 3 is a perspective view illustrating an outdoor unit equipped with an airflow directing apparatus in the air conditioner shown in FIG. 1.

FIG. 3 is a perspective view illustrating an outdoor unit equipped with an airflow directing apparatus in the air conditioner shown in FIG. 1.

In FIG. 3, the airflow directing apparatus 40 may include a suction directing cover 41 to direct the flow of air suctioned through the air inlet 11*a*, and a discharge directing cover 42 to direct the flow of air discharged through the air outlet 11*b*.

The suction directing cover 41 may be mounted to outer surfaces of the back cabinet 11*f* and one pair of side cabinets 11*g* so as to direct the suctioned air to the back surfaces and both side surfaces of the cabinet 11 through the air inlet 11*a*, and may be formed to surround the back cabinet 11*f* and the one pair of side cabinets 11*g* as well as to cover the condenser 13 arranged at three sides.

The suction directing cover 41 may include an inlet 41*a* provided at a lower part thereof such that the air suctioned through the air inlet 11*a* may be directed in an upward direction during suction of the outdoor air.

The discharge directing cover 42 may be mounted to the top of the cabinet 11 so as to direct the air discharged to the top surface of the cabinet 11 through the air outlet 11*b*, may cover the air outlet 11*b*, and may be mounted to the top of the air outlet 11*b*.

An outlet 42*a* may be provided at the front of the discharge directing cover 42, such that the outlet 42*a* may direct the air discharged through the air outlet 11*b* in a downward direction during discharge of the heat-exchanged air.

In addition, a plurality of blades 44 formed to adjust the amount of flowing outdoor air discharged through the outlet 42*a* may be mounted to the front surface of the discharge directing cover 42.

The blades 44 may control the amount of heat exchange of the condenser 14 by adjusting the amount of flowing outdoor air discharged through the outlet 42*a*.

In this case, the operation for controlling the amount of heat exchange of the condenser 13 may indicate that the angle of each blade 44 is changed in the range from a fully open state to a fully closed state such that the amount of heat exchange between the condenser 13 and the outdoor air is controlled. Generally, the higher the amount of heat exchange, the lower the pressure of the condenser 13.

Figure 4:
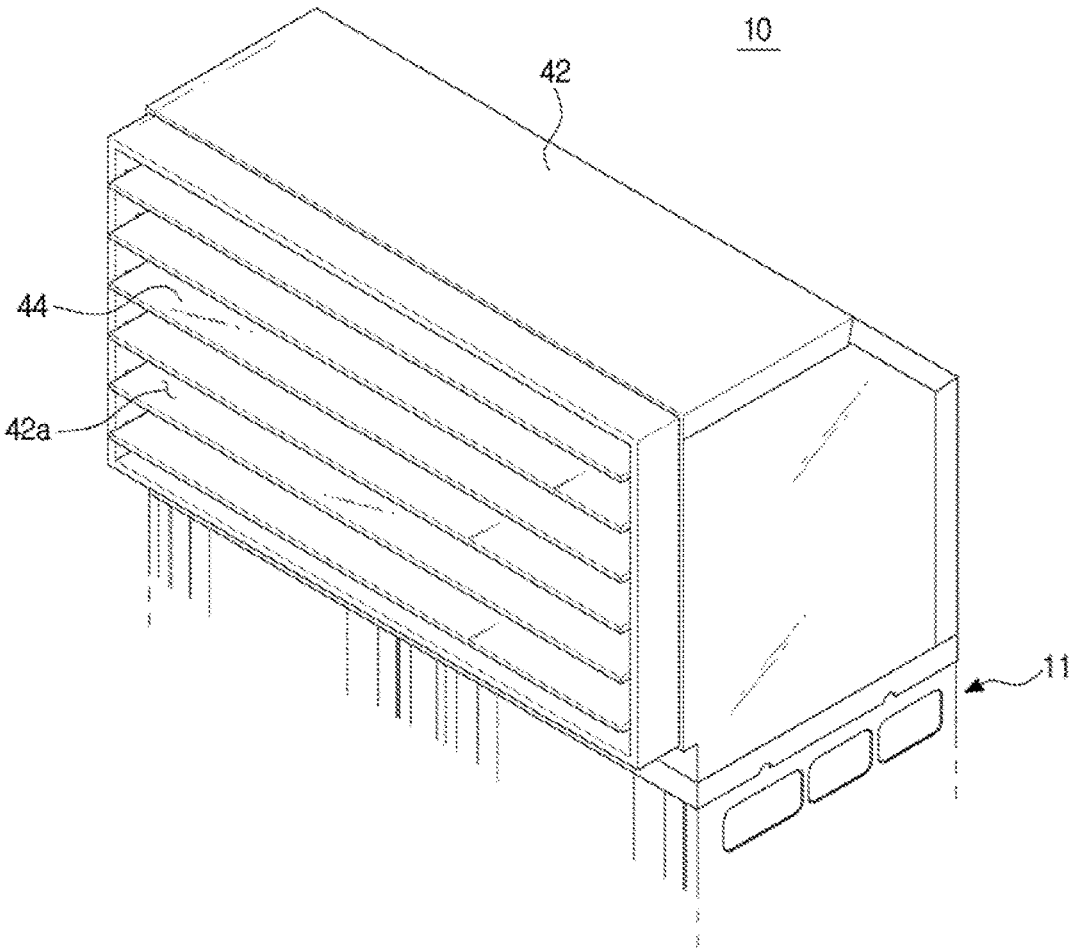
FIG. 4 is a view illustrating an open state of blades of the airflow directing apparatus shown in FIG. 3.
Figure 5:
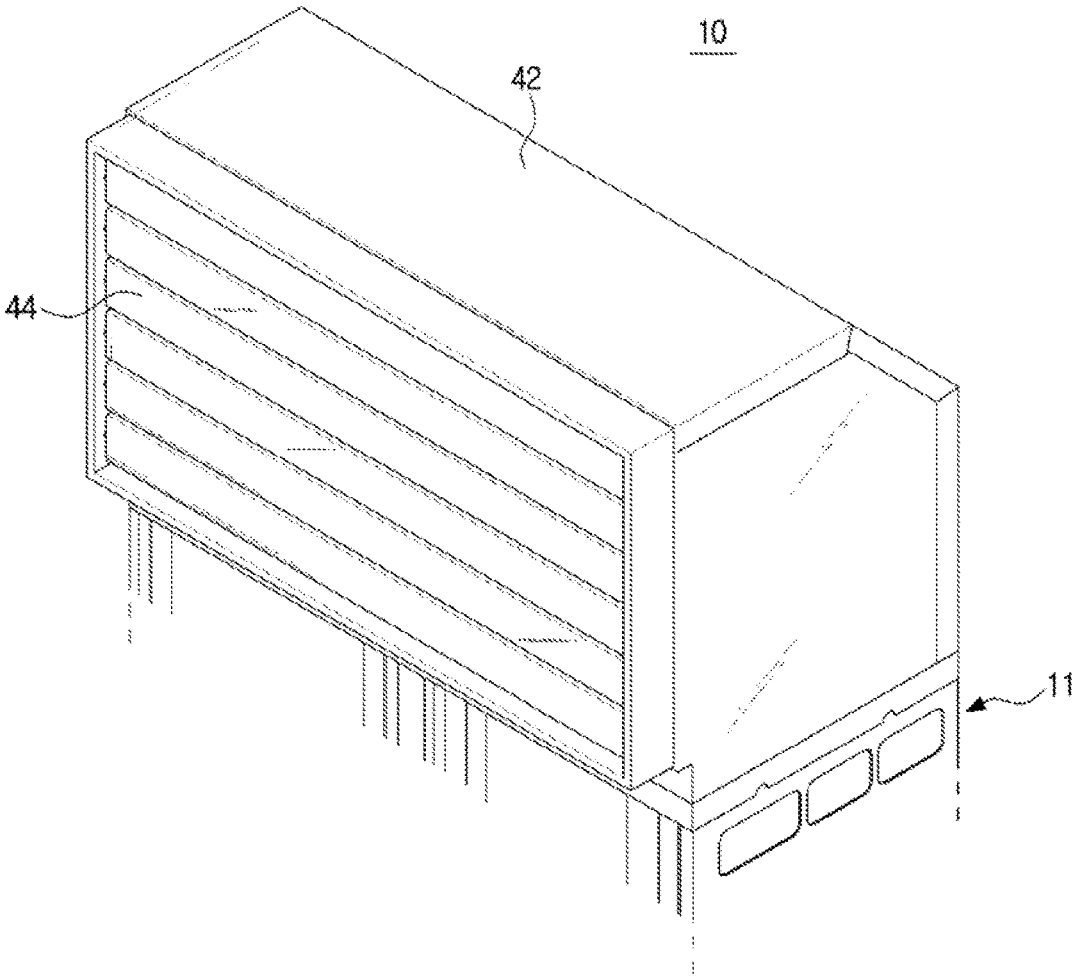
FIG. 5 is a view illustrating a closed state of blades of the airflow directing apparatus shown in FIG. 3.

FIG. 4 is a view illustrating an open state of blades of the airflow directing apparatus shown in FIG. 3. FIG. 5 is a view illustrating a closed state of blades of the airflow directing apparatus shown in FIG. 3.

Referring to FIGS. 4 and 5, the fully open state of each blade 44 may be defined as 90°, and the fully closed state of each blade 44 may be defined as 0°. The fully open state of each blade 44 may be defined as a fully open step (3 step) corresponding to 90° of each blade 44. The fully closed state of each blade 44 may be defined as a fully closed step (0 step) corresponding to 0° of each blade 44.

Therefore, the angle of each blade 44 may be changed in the range from the fully open step (90°) to the fully closed step (0°). In more detail, the angle of each blade 44 may be changed to any of 0° (0-step), 30° (1-step), 60° (2-step), and 90° (3-step). The above-mentioned angle change of the blade 44 may be controlled according to condenser pressure (high pressure), evaporator pressure (low pressure), and a compression ratio between the condenser pressure (high pressure) and the evaporator pressure (low pressure).

By the above-mentioned structure, the outdoor unit 10 of the air conditioner according to one embodiment may include blades 44 in the discharge directing cover 42, such that the outdoor unit 10 may control the amount of outdoor air flowing in the cabinet 11 by angle change (step change) of the blades 44. Accordingly, the amount of heat exchange between the condenser 13 and the outdoor air is controlled such that an efficient cooling cycle may be formed and reliability of the compressor 12 may be guaranteed.

The outdoor unit 10 of the air conditioner according to one embodiment may correctly control the amount of heat exchange of the condenser 13 according to angle change of the blades 44.

FIG. 6 is a conceptual diagram illustrating a cooling cycle of the air conditioner according to an embodiment of the present disclosure.

Referring to FIG. 6, the cooling cycle of the air conditioner 1 may include the compressor 12, the condenser 13, the expansion valve 19, and the evaporator 22. The cooling cycle is a series of processes composed of compression, condensing, expansion, and evaporation, and provides low-temperature temperature to the indoor space using movement of heat generated in evaporation and condensing processes of refrigerant during circulation of the refrigerant.

The compressor 12 may compress the refrigerant into a high-temperature and high-pressure gaseous state, and may discharge the compressed refrigerant. The discharged refrigerant may be introduced into the condenser 13.

The condenser 13 may condense the high-temperature and high-pressure gaseous refrigerant in a normal-temperature and high-pressure gaseous state, and may emit heat to the outside through the condensing process. As a result, the refrigerant is condensed by the condenser 13, resulting in reduction in temperature.

The expansion valve 19 may expand and decompress the normal-temperature and high-pressure liquid refrigerant condensed by the condenser 13 into a low-temperature and low-pressure state, resulting in occurrence of a low-temperature and low-pressure two-phase refrigerant composed of a mixture of low-temperature and low-pressure gas and liquid components.

The evaporator 22 may evaporate the decompressed low-temperature and low-pressure liquid refrigerant obtained from the expansion valve 19 into a gaseous state. The evaporator 22 may achieve the cooling effect by exchanging latent heat generated during evaporation of the refrigerant with a target object to be cooled, and may return the low-temperature and low-pressure gaseous refrigerant to the compressor 10. By the cooling cycle, air-conditioned air may be supplied to the indoor space.

The compressor 12 and the condenser 13 in the cooling cycle of the air conditioner 1 may be located in the outdoor unit 10. The expansion valve 19 may be located at any one of the indoor unit 20 and the outdoor unit 10, and the evaporator 22 may be located in the indoor unit 20.

Although the embodiment of the present disclosure has exemplarily disclosed that the cooling operation is performed in the cooling cycle of the air conditioner 1 for convenience of description, the scope or spirit of the present disclosure is not limited thereto, and it should be noted that a heating operation of the air conditioner 1 may also be performed by switching refrigerant flow of the cooling cycle using a 4-way valve (not shown).

The air conditioner 1 for cooling or heating the indoor space using the cooling cycle may further include first and second pressure sensors 17 and 18 configured to detect condenser pressure (high pressure) and evaporator pressure (low pressure) such that the air conditioner 1 may guarantee the cooling performance in an outdoor low-temperature condition and may perform the cooling operation in an efficient cooling cycle using the first and second pressure sensors 17 and 18. The first and second pressure sensors 17 and 18 will hereinafter be described with reference to FIG. 7.

Figure 7:
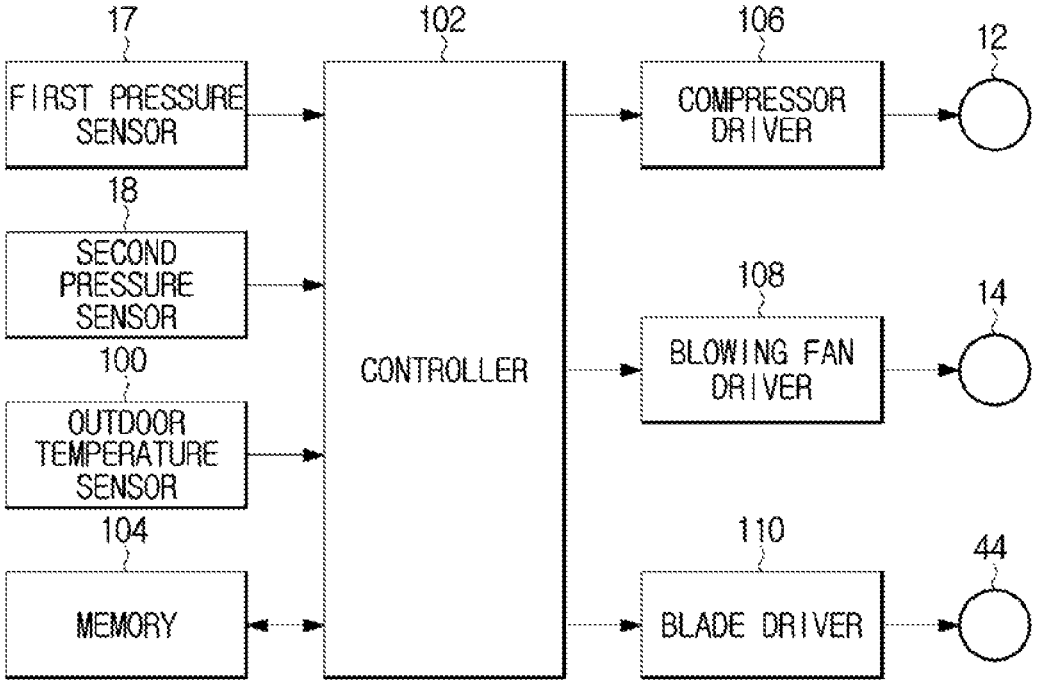
FIG. 7 is a block diagram illustrating the outdoor unit of the air conditioner according to an embodiment of the present disclosure.

FIG. 7 is a block diagram illustrating the outdoor unit of the air conditioner according to an embodiment of the present disclosure.

Referring to FIG. 7, the outdoor unit 10 of the air conditioner may include not only constituent elements of FIGS. 1 to 6 but also a first pressure sensor 17, a second temperature pressure sensor 18, an outdoor temperature sensor 100, a controller 102, a memory 104, a compressor driver 106, a blowing fan driver 108, and a blade driver 110.

The first pressure sensor 17 is installed in a discharge part of the compressor 12, detects pressure (condenser pressure) of a high-pressure part of a refrigerant discharged from the compressor 12, and transmits the detected pressure to the controller 102.

The second pressure sensor 18 is installed in a suction part of the compressor 12, detects pressure (evaporator pressure)

of a low-pressure part of a refrigerant suctioned into the compressor 12, and transmits the detected pressure to the controller 102.

The outdoor temperature sensor 100 may detect a temperature of the outdoor space including the outdoor unit 10, and may transmit the detected temperature to the controller 102.

The controller 102, which is a microprocessor for controlling overall operation of the outdoor unit 10 of the air conditioner, receives not only pressure information from the first and second pressure sensors 17 and 18, but also temperature information from the outdoor temperature sensor 100, and transmits a control command to the blade driver 110 on the basis of the received pressure and temperature information.

The controller 102 may compare an outdoor temperature $T_o$ detected by the outdoor temperature sensor 100 with a predetermined reference temperature $T_s$ (e.g., 5° that is used to determine whether a current condition is an outdoor low-temperature condition). If the outdoor temperature $T_o$ is less than the reference temperature $T_s$, this means that a current condition is an outdoor low-temperature condition.

In addition, the controller 102 may change the angle of each blade 44 according to condenser pressure (high pressure) detected by the first pressure sensor 17, evaporator pressure (low pressure) detected by the second pressure sensor 18, and a compression ratio between the condenser pressure (high pressure) and the evaporator pressure (low pressure).

Therefore, the controller 102 may change the angle (step) of each blade 44 in the range from a fully open step (90°, 3-step) to a fully closed step (0°, 0-step) according to condenser pressure (high pressure), evaporator pressure (low pressure), and a compression ratio between the condenser pressure (high pressure) and the evaporator pressure (low pressure). In more detail, the angle of each blade 44 may be changed to any of 0° (0-step), 30° (1-step), 60° (2-step), and 90° (3-step) according to condenser pressure (high pressure), evaporator pressure (low pressure), and a compression ratio between the condenser pressure (high pressure) and the evaporator pressure (low pressure).

By the above-mentioned structure, the outdoor unit 10 of the air conditioner may include blades 44 in the discharge directing cover 42, such that the outdoor unit 10 may control the amount of outdoor air flowing in the cabinet 11 by angle change (step change) of the blades 44. Accordingly, the amount of heat exchange between the condenser 13 and the outdoor air is controlled such that an efficient cooling cycle may be formed and reliability of the compressor 12 may be guaranteed.

The memory 104 may store control data for controlling operation of the outdoor unit 10 of the air conditioner, reference data used in operation control of the outdoor unit 10, operation data generated during predetermined operation of the outdoor unit 10, cooling/heating information entered by a user who desires to command the outdoor unit 10 to perform the predetermined operation, the presence or absence of a scheduled operation, and malfunction information including the case of malfunction or the position of malfunction during malfunction of the outdoor unit 10.

The memory 104 may store the amount of change for each step of the blades 44 according to a compression ratio decided by condenser pressure (high pressure) and evaporator pressure (low pressure), a current step of the blades 44, and the evaporator pressure (low pressure).

The memory 104 may be implemented as a non-volatile memory device such as a read only memory (ROM), programmable read only memory (PROM), erasable programmable read only memory (EPROM), or flash memory, a volatile memory device such as a random access memory (RAM), or a storage unit such as a hard disk, a card type memory (e.g. a Secure Digital (SD) memory or an eXtreme Digital (XD) memory), etc. However, the memory 104 is not limited thereto and may also be implemented as any other storage devices known to those skilled in the art.

The compressor driver 106 may control the on/off operation of the compressor 12 according to a compressor control signal of the controller 102.

The blowing fan driver 108 may control the on/off operation of the blowing fan 14 according to a fan control signal of the controller 102, and may include a blowing motor 15, and the like.

The blade driver 110 may change the angle (step) of each blade 44 according to a blade control signal of the controller 102.

An air conditioner including the airflow directing apparatus, a method for controlling the same, and the effects of the air conditioner and the control method according to one embodiment of the present disclosure will hereinafter be described.

Figure 8A:
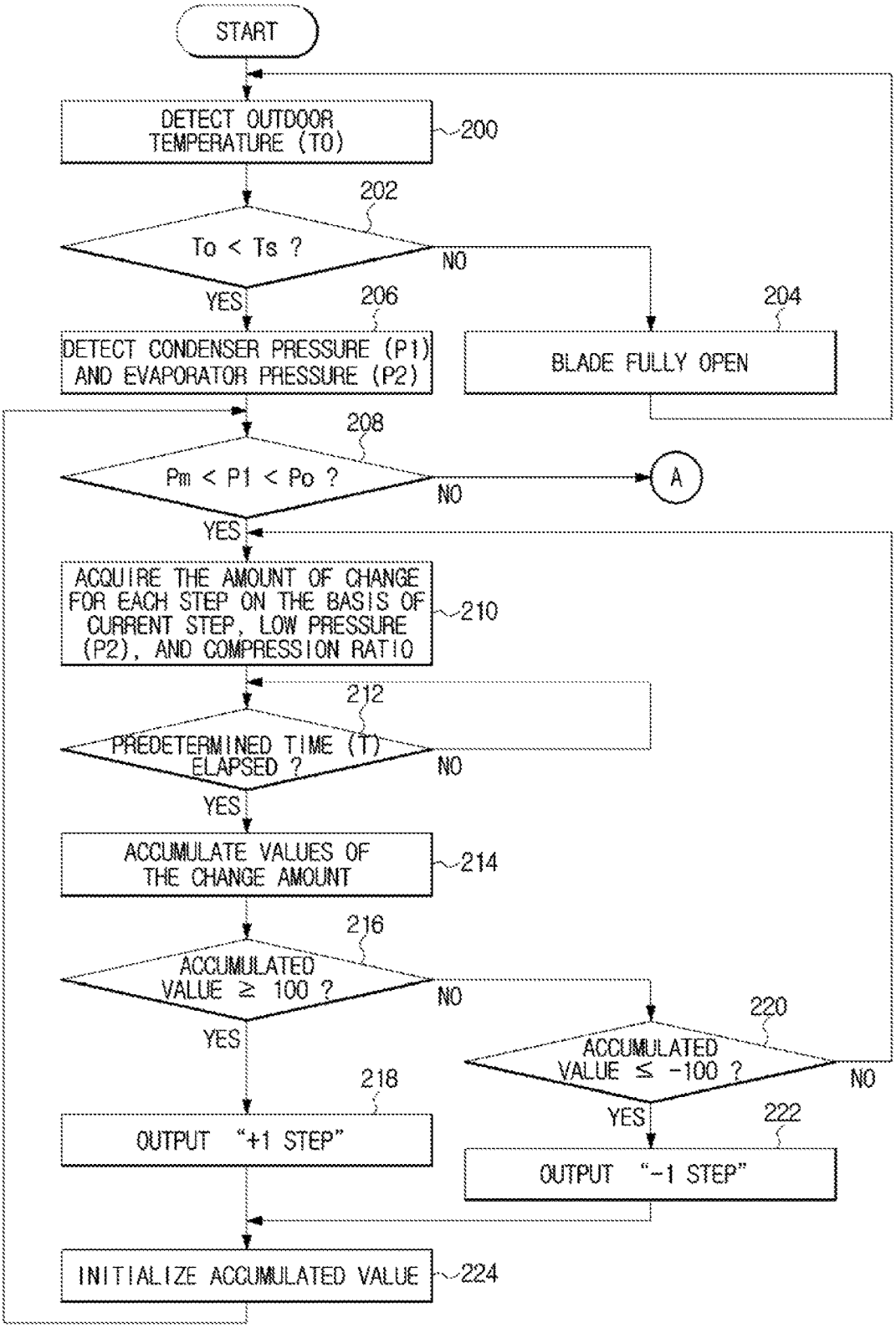
FIGS. 8A and 8B are flowcharts illustrating an algorithm for controlling blades in a low-temperature operation region of the outdoor unit of the air conditioner according to an embodiment of the present disclosure.
Figure 8B:
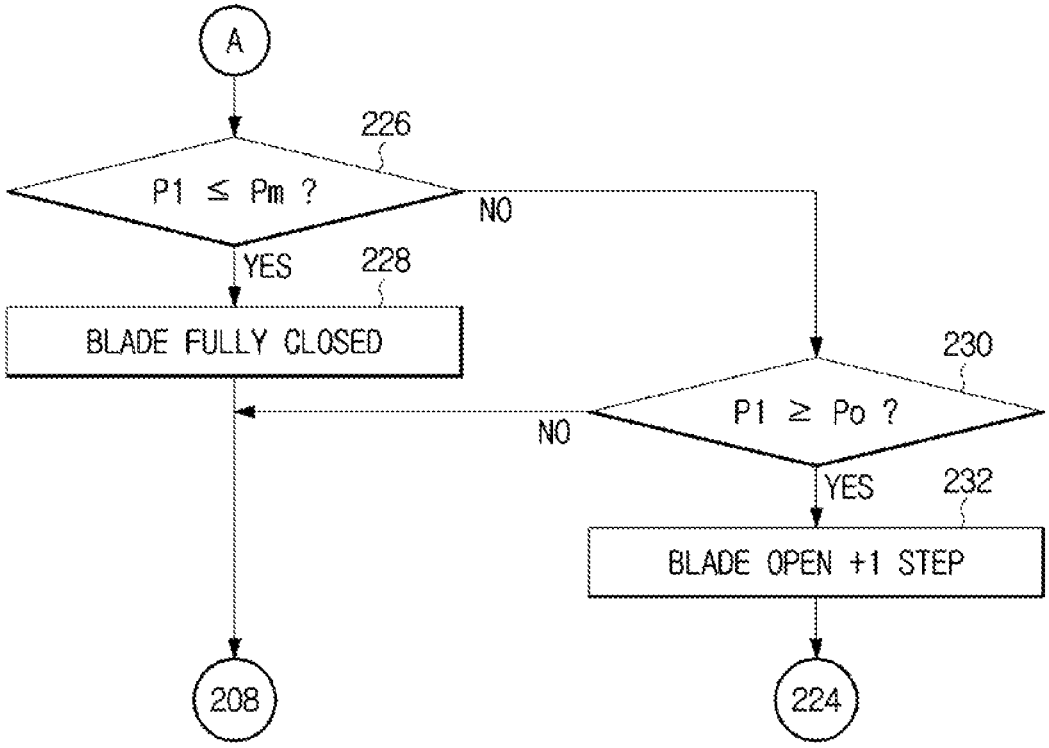

FIGS. 8A and 8B are flowcharts illustrating an algorithm for controlling blades in a low-temperature operation region of the outdoor unit of the air conditioner according to an embodiment of the present disclosure. FIG. 9 is a table illustrating the amount of change for each step of blades in a low-temperature operation region of the outdoor unit of the air conditioner according to an embodiment of the present disclosure.

Referring to FIGS. 8A and 8B, the outdoor temperature sensor 100 may detect a temperature $T_o$ of the outdoor space including the outdoor unit 10, and may transmit the detected temperature $T_o$ to the controller 102 (Operation 200).

Therefore, the controller 102 may compare the outdoor temperature $T_o$ detected by the outdoor temperature sensor 100 with a predetermined reference temperature $T_s$ (e.g., 5° that is used to determine whether a current condition is an outdoor low-temperature condition), and may determine whether the outdoor temperature $T_o$ is less than the reference temperature $T_s$ (Operation 202).

If the outdoor temperature $T_o$ is not less than the reference temperature $T_s$ (Operation 202), the controller 102 may determine that a current condition is not an outdoor low-temperature condition, and may control the angle of each blade 44 in a fully open state (fully open step) (90°, 3-step) through the blade driver 110 (Operation 204). If the current condition is not identical to the outdoor low-temperature condition, heat exchange caused by natural convection of the air need not be suppressed, such that the blades 44 may be fully opened.

If the outdoor temperature $T_o$ is less than the reference temperature $T_s$ (Operation 202), the controller 102 may determine that a current condition is the outdoor low-temperature condition, and may control the angle (step) of the blades 44 in such a manner that the amount of heat exchange between the condenser 13 and the outdoor air may be controlled during the cooling operation in the outdoor low-temperature condition.

For this purpose, the controller 102 may detect pressure of a high-pressure part (i.e., condenser pressure, P1) of the refrigerant discharged from the compressor 12 through the first pressure sensor 17 mounted to a discharge part of the compressor 12, and may detect pressure of a low-pressure part (i.e., evaporator pressure, P2) of the refrigerant suctioned into the compressor 12 through the second pressure sensor 18 mounted to a suction part of the compressor 12 (Operation 206).

The controller 102 may calculate the compression ratio (P1/P2) using the detected condenser pressure (high pressure, P1) and the evaporator pressure (low pressure, P2).

Figure 10:
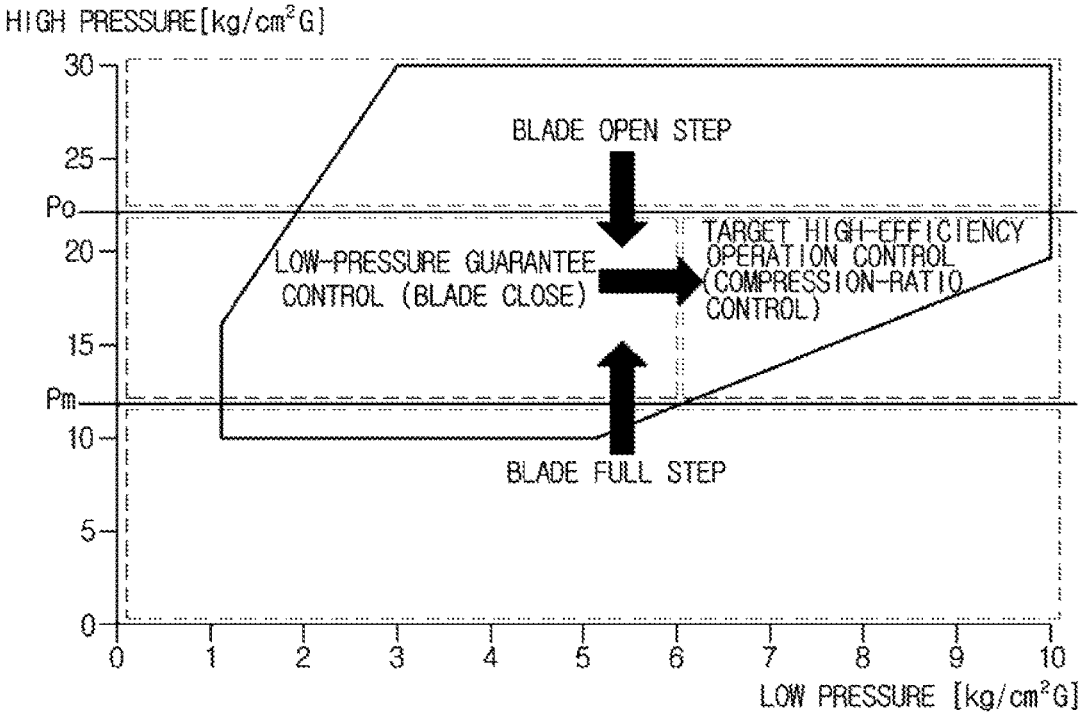
FIG. 10 is a conceptual diagram illustrating a compressor guarantee operation region for guaranteeing cooling performance of a low-temperature operation region of the outdoor unit of the air conditioner according to an embodiment of the present disclosure.

Subsequently, as shown in FIG. 10, the controller 102 may determine whether the condenser pressure (high pressure, P1) is higher than a minimum requested high pressure ($P_m$, 12 kgf/cm$^2$ G) and is less than an efficient-region high pressure ($P_o$, 22.5 kgf/cm$^2$ G) (Operation 208).

In Operation 208, when the condenser pressure (high pressure, P1) is higher than the minimum requested high pressure ($P_m$) and is less than the efficient-region high pressure ($P_o$), the controller 102 may control the angle (step) of the blades 44 on the basis of the amount of change for each step of the blades 44. Here, the amount of change for each step may be stored in the memory 104.

First, the controller 102 may acquire the amount of change for each step of the blades 44 from the memory 104 on the basis of a current step (angle) of the blades 44, the evaporator pressure (low pressure, P2), and the compression ratio (P1/P2) calculated using the condenser pressure (high pressure, P1) and the evaporator pressure (low pressure, P2) (Operation 210). For example, when the compression ratio (P1/P2) is equal to or higher than 2.8 and the evaporator pressure (low pressure, P2) is less than 6 kgf/cm$^2$ G, the amount of change for each step of the blades 44 may be set to 0, −40, or −50 according to a current step (e.g., 0-step, 1-step, 2-step, or 3-step) of each blade 44 (See FIG. 9).

Subsequently, the controller 102 may determine whether a predetermined time (t) (i.e., a proper time needed to acquire the amount of change for each step of the blade, for example, about 30 seconds) has elapsed (Operation 212).

If the predetermined time (t) has elapsed (Operation 212), the controller 102 may acquire values indicating the amount of change for each step of the blades 44 at intervals of a predetermined time (t), and may accumulate and calculate the acquired values (Operation 214).

Therefore, the controller 102 may determine whether the accumulated value (i.e., the accumulated calculation change amount) is equal to or higher than 100 (Operation 216). If the accumulated value (i.e., the accumulated calculation change amount) is equal to or higher than 100 (Operation 216), the controller 102 may output the output step of each blade 44 as "+1 step" (blade open step), such that the angle of each blade 44 may be changed from a current step (old step) of each blade 44 to the changed output step "+1 step" (Operation 218).

For example, if a current step (old step) of each blade 44 is set to 0-step) (0°), the output step of the blade 44 is changed to 1-step, such that the angle of the blade 44 is changed to 30°. If a current step (old step) of each blade 44 is set to 1-step (30°), the output step of the blade 44 is changed to 2-step, such that the angle of the blade 44 is changed to 30°. If a current step (old step) of each blade 44 is set to 2-step (60°), the output step of the blade 44 is changed to 3-step, such that the angle of the blade 44 is changed to 90° (fully open state).

If the accumulated value is less than 100 (Operation 216), the controller 102 may determine whether the accumulated value is equal to or less than −100 (Operation 220).

If the accumulated value is higher than −100 (Operation 220), the controller 102 may return to operation 210, and thus perform subsequent operations.

If the accumulated value is equal to or less than −100 (Operation 220), the controller 102 may output the output step of each blade 44 as "−1 step" (blade close step), such that the angle of each blade 44 may be changed from a current step (old step) of each blade 44 to the changed output step "−1 step" (Operation 222). For example, if a current step (old step) of each blade 44 is set to 3-step (90°), the output step of the blade 44 is changed to 2-step, such that the angle of the blade 44 is changed to 60°. If a current step (old step) of each blade 44 is set to 2-step (60°), the output step of the blade 44 is changed to 1-step, such that the angle of the blade 44 is changed to 30°. If a current step (old step) of each blade 44 is set to 1-step (60°), the output step of the blade 44 is changed to 0-step, such that the angle of the blade 44 is changed to 0° (fully closed state).

If the step of each blade 44 is changed, the controller 102 may initialize the accumulated value (i.e., the accumulated calculation change amount) (Operation 224), may return to operation 208, and may thus perform subsequent operations.

If the condenser pressure (high pressure, P1) is not higher than a minimum requested high pressure ($P_m$) or is not less than the efficient-region high pressure ($P_o$) (Operation 208), the controller 102 may determine whether the condenser pressure (high pressure, P1) is equal to or less than the minimum requested high pressure ($P_m$) (Operation 226).

If the condenser pressure (high pressure, P1) is equal to or less than the minimum requested high pressure ($P_m$) (Operation 226), the controller 102 may control the angle of the blade 44 in a fully closed step (0°, 0-step) corresponding to a fully closed state using the blade driver 110 such that the minimum requested high pressure ($P_m$) may be primarily satisfied (Operation 228). If the condenser pressure (high pressure, P1) is less than the minimum requested high pressure ($P_m$), the controller 102 may control the blade 44 to be fully closed, such that the amount of heat exchange of the condenser 13 is suppressed, resulting in increased condenser pressure (high pressure).

If the condenser pressure (high pressure, P1) is higher than the minimum requested high pressure ($P_m$) (Operation 226), the controller 102 may determine whether the condenser pressure (high pressure, P1) is equal to or higher than the efficient-region high pressure ($P_o$) (Operation 230).

If the condenser pressure (high pressure, P1) is less than the efficient-region high pressure ($P_o$) (Operation 230), the controller 102 proceeds to operation 208 and thus performs subsequent operations.

If the condenser pressure (high pressure, P1) is equal to or higher than the efficient-region high pressure ($P_o$) (Operation 230), the controller 102 may output the output step of each blade 44 as "+1 step" (blade open step), such that the angle of each blade 44 may be changed from a current step (old step) of each blade 44 to the changed output step "+1 step" (Operation 232).

For example, if a current step (old step) of each blade 44 is set to 0-step (0°), the output step of the blade 44 is changed to 1-step, such that the angle of the blade 44 is changed to 30°. If a current step (old step) of each blade 44 is set to 1-step (30°), the output step of the blade 44 is changed to 2-step, such that the angle of the blade 44 is changed to 60°. If a current step (old step) of each blade 44 is set to 2-step (60°), the output step of the blade 44 is changed to 3-step, such that the angle of the blade 44 is changed to 90° (fully open state).

As described above, if the condenser pressure (high pressure, P1) is higher than the efficient-region high pressure ($P_o$), the controller 102 may open the blade 44 to increase the amount of heat exchange of the condenser 13, resulting in reduction of the condenser pressure (high pressure).

FIG. 10 is a conceptual diagram illustrating a compressor guarantee operation region for guaranteeing cooling performance of a low-temperature operation region of the outdoor unit of the air conditioner according to an embodiment of the present disclosure.

In FIG. 10, a solid-lined part may denote a compressor guarantee operation region in which an efficient cooling cycle is formed and reliability of the compressor 12 may be guaranteed.

In order to implement a target high-efficiency operation (compression-ratio control) within the compressor guarantee operation region, the evaporator pressure (low pressure, P2), the compression ratio (P1/P2), and a current angle (step) of each blade 44 are determined such that the angle (step) of the blade 44 is changed. The amount of outdoor air flowing in the outdoor unit 10 of the air conditioner 1 may be adjusted according to angle (step) change of the blade 44, such that the amount of heat exchange of the condenser 13 may be controlled.

The operation for controlling the amount of heat exchange of the condenser 13 may change the angle (step) of the blade 44 to any one of 0° (0-step), 30° (1-step), 60° (2-step), and 90° (3-step) in the range from a fully open step to a fully closed step, thereby controlling the amount of heat exchange between the condenser 13 and the outdoor air.

As the blade 44 is sequentially opened in the order of 0° (0-step, fully closed step)→30° (1-step)→60° (2-step)→90° (3-step, fully open step), the amount of heat exchange between the condenser 13 and the outdoor air is gradually increased and the condenser pressure (high pressure) is gradually lowered (see FIG. 8).

In contrast, as the blade is sequentially closed in the order of 90° (3-step, fully open step)→60° (2-step)→30° (1-step)→0° (0-step, fully closed step), the amount of heat exchange between the condenser 13 and the outdoor air is gradually reduced and the condenser pressure (high pressure) is gradually increased (see FIG. 8).

As described above, since the condenser pressure (high pressure, P1) is guaranteed within the compressor guarantee operation region due to angle (step) change of the blade 44, the condenser pressure (high pressure, P1) may be controlled at a target high pressure between the minimum requested high pressure ($P_m$) and the efficient-region high pressure ($P_0$).

Although the embodiment of the present disclosure has exemplarily disclosed that high pressure and low pressure are respectively detected by the first and second pressure sensors 17 and 18 respectively mounted to a discharge part and a suction part of the compressor 12 such that the angle (step) of the blade 44 is controlled, the scope or spirit of the present disclosure is not limited thereto, and it should be noted that the outdoor unit 10 of the air conditioner 1 having no pressure sensor may control the angle (step) of the blade 44 using an outlet temperature (condenser intermediate temperature) of the condenser 13 and saturation pressure of an inlet temperature of the evaporator 22, instead of using high pressure and low pressure, such that the same objects and effects as those of the present disclosure may be accomplished.

In addition, although the embodiment of the present disclosure has exemplarily disclosed that the angle (step) of each blade 44 is changed according to a current angle (step) of the blade 44 for convenience of description, the scope or spirit of the present disclosure is not limited thereto, a negative (−) output or a positive (+) output may also be controlled by low pressure and the compression ratio without recognition of the current angle (step) of the blade 44 according to the control scheme of the blade 44.

As is apparent from the above description, in the air conditioner according to the embodiments of the present disclosure, an airflow directing apparatus, which is installed in an outdoor unit, suppresses not only natural convection of the air, but also heat exchange between the condenser and outdoor air by the blowing fan, such that the air conditioner can form a normal cooling cycle by guaranteeing condenser pressure.

In addition, the air conditioner can guarantee cooling performance of a low-temperature operation region by adjusting the amount of outdoor air flowing through blade control of the airflow directing apparatus, and can operate in an efficient cooling cycle, resulting in acquisition of compressor reliability.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An air conditioner comprising:

a cabinet configured to form an external surface of an outdoor unit, and including an air inlet and an air outlet;

a heat-exchanger accommodated in the cabinet to perform heat exchange;

a blowing fan configured to suction air through the air inlet, cause the suctioned air to pass through the heat-exchanger to form heat-exchanged air, and discharge the heat-exchanged air through the air outlet;

a discharge directing cover provided at an upper part of the air outlet, and configured to direct flow of the heat-exchanged air to an outlet of the discharge directing cover;

at least one blade coupled to the outlet of the discharge directing cover, and configured to adjust an amount of the flow of the heat-exchanged air;

a compressor disposed in the cabinet, and configured to compress a refrigerant;

at least one pressure sensor mounted to each of a discharge part and a suction part of the compressor, and configured to detect high pressure of a high pressure part of the refrigerant passing through the compressor and low pressure of a low pressure part of the refrigerant passing through the compressor; and a controller configured to control the amount of the flow of heat-exchanged air by controlling an angle of the at least one blade according to the low pressure detected by the at least one pressure sensor, a compression ratio, and a current angle of the at least one blade.

2. The air conditioner according to claim 1, wherein the heat-exchanger is a condenser configured to condense the refrigerant discharged from the compressor through heat exchange between the refrigerant and the suctioned air to form the heat-exchanged air.

3. The air conditioner according to claim 2, wherein:

the cabinet includes a rear surface and a pair of side surfaces, the air inlet is formed in the rear surface and the pair of side surfaces, and the condenser is configured to be proximate to the rear surface and the pair of side surfaces of the cabinet, and perform the heat exchange between the condenser and the suctioned air suctioned through the air inlet formed in the rear surface and the pair of side surfaces of the cabinet.

4. The air conditioner according to claim 1, wherein the compression ratio is a value that is acquired by dividing the detected high pressure by the detected low pressure.

5. The air conditioner according to claim 1, wherein:

when the detected high pressure is equal to or lower than a minimum high pressure, the controller controls the angle of the at least one blade with a full close output, so that the at least one blade is closed and the outlet of the discharge directing cover is closed.

6. The air conditioner according to claim 1, wherein:

when the detected high pressure is higher than a minimum high pressure, the controller controls the angle of the at least one blade with an open output, so that the at least one blade is opened by a predetermined amount and the amount of the flow of the heat-exchanged air is adjusted.

7. The air conditioner according to claim 1, wherein:

when the detected high pressure is higher than a minimum high pressure, the controller controls the angle of the at least one blade with an open output or a close output according to the detected low pressure, a compression ratio, and a current angle of the at least one blade, so that the at least one blade is opened by a predetermined amount or closed by a predetermined amount and the amount of the flow of the heat-exchanged air is adjusted.

8. The air conditioner according to claim 1, further comprising:

an outdoor temperature sensor configured to detect an outdoor temperature of an outdoor space in which the outdoor unit is installed, wherein the controller compares the outdoor temperature detected by the outdoor temperature sensor with a reference temperature, determines an outdoor low-temperature condition when the outdoor temperature is lower than the reference temperature, and controls the angle of the at least one blade in a low-temperature operation region in response to the determination of the outdoor low-temperature condition.

9. The air conditioner according to claim 1, wherein the air outlet is formed in a top surface of the cabinet, and the discharge directing cover is formed to cover the air outlet and is provided at an upper part of the cabinet to direct the heat-exchanged air discharged through the top surface of the cabinet through the air outlet.

10. The air conditioner according to claim 1, wherein the cabinet includes a rear surface and a pair of side surfaces, the air inlet is formed in the rear surface and the pair of side surfaces, and wherein the air conditioner further comprises:

a suction directing cover provided at the rear surface and the pair of side surfaces of the cabinet so as to direct the suctioned air suctioned through the rear surface and both side surfaces of the cabinet through the air inlet, and configured to surround the rear surface and the pair of side surfaces of the cabinet.

11. A method for controlling an air conditioner which includes a controller, a temperature sensor, a cabinet having an air inlet and an air outlet, a heat-exchanger accommodated in the cabinet to perform heat exchange, a compressor provided in the cabinet to compress a refrigerant, a discharge directing cover provided at an upper part of the air outlet and configured to direct flow of heat-exchanged air in the heat-exchanger, and at least one blade coupled to an outlet of the discharge directing cover, the method comprising:

detecting, by the temperature sensor, an outdoor temperature; and by the controller:

comparing the detected outdoor temperature with a reference temperature, and determining whether the detected outdoor temperature is lower than the reference temperature;

when the detected outdoor temperature is lower than the reference temperature, detecting a high pressure of a high-pressure part and a low pressure of a low-pressure part of the refrigerant passing through the compressor; and controlling an angle of the at least one blade according to the detected low pressure, a compression ratio, and a current angle of the at least one blade so as to adjust an amount of the flow of the heat-exchanged air.

12. The method according to claim 11, wherein the controlling the angle of the at least one blade includes:

suctioning air through the air inlet, and adjusting the amount of the flow of heat-exchanged air by adjusting an amount of flow of the suctioned air through the heat-exchanger, so that an amount of heat exchange of the heat-exchanger is adjusted.

13. The method according to claim 11, further comprising:

when the detected high pressure is equal to or lower than a minimum high pressure, controlling, by the controller, the angle of the at least one blade with a full close output, so that the at least one blade is closed and the outlet of the discharge directing cover is closed.

14. The method according to claim 11, further comprising:

when the detected high pressure is higher than a minimum high pressure, controlling, by the controller, the angle of the at least one blade with an open output, so that the at least one blade is opened by a predetermined amount and the amount of the flow of the heat-exchanged air is adjusted.

15. The method according to claim 11, further comprising:

when the detected high pressure is higher than a minimum high pressure, controlling, by the controller, the angle of the at least one blade with an open output or a close output according to the detected low pressure, a compression ratio, and a current angle of the at least one blade, so that the at least one blade is opened by a predetermined amount or closed by a predetermined amount and the amount of the flow of the heat-exchanged air is adjusted.

16. The method according to claim 15, wherein the compression ratio is a value that is acquired by dividing the detected high pressure by the detected low pressure.

17. An air conditioner comprising:

a cabinet configured to form an external surface of an outdoor unit, and have an air inlet and an air outlet;

a heat-exchanger accommodated in the cabinet to perform heat exchange;

a compressor provided in the cabinet, configured to compress a refrigerant, and provide the compressed refrigerant to the heat-exchanger;

a blowing fan configured to suction air through the air inlet, cause the suctioned air to pass through the heat-exchanger to form heat-exchanged air, and discharge the heat-exchanged air through the air outlet;

a discharge directing cover provided at an upper part of the air outlet, and configured to direct flow of the heat-exchanged air to an outlet of the discharge directing cover;

at least one blade coupled to the outlet of the discharge directing cover, and configured to adjust an amount of flow of the heat-exchanged air;

at least one pressure sensor mounted to each of a discharge part and a suction part of the compressor, and configured to detect high pressure of a high pressure part of the refrigerant passing through the compressor and low pressure of a low pressure part of the refrigerant passing through the compressor; and a controller configured to control the amount of the flow of the heat-exchanged air by controlling an angle of the at least one blade according to the low pressure detected by the at least one pressure sensor, a compression ratio, and a current angle of the at least one blade.

18. The air conditioner according to claim 17, wherein:

when the high pressure of the high-pressure part of the refrigerant passing through the compressor is equal to or lower than a minimum high pressure, the controller controls the angle of the at least one blade with a fully closed output, so that the at least one blade is closed and the outlet of the discharge directing cover is closed.

* * * * *